United States Patent [19]

Murtha

[11] Patent Number: 4,615,744

[45] Date of Patent: Oct. 7, 1986

[54] METHOD OF RINSING EATING UTENSILS

[76] Inventor: James L. Murtha, 4405 Marcourt La., West Des Moines, Iowa 50265

[21] Appl. No.: 778,804

[22] Filed: Sep. 23, 1985

Related U.S. Application Data

[63] Continuation of Ser. No. 603,164, Apr. 23, 1984, abandoned.

[51] Int. Cl.[4] ..... B08B 3/10

[52] U.S. Cl. ..... 134/25.2; 134/10; 134/57 D; 134/108

[58] Field of Search ..... 134/10, 13, 18, 25.2, 134/56 D, 57 D, 58 D, 108, 109, 113

[56] References Cited

U.S. PATENT DOCUMENTS

| | | | |
|---|---|---|---|
| Re. 23,788 | 2/1954 | Detjen | 134/25.2 |
| 2,825,666 | 3/1958 | Stoddard | 134/25.2 |
| 3,476,600 | 11/1969 | Morgan et al. | 134/25.2 |
| 4,156,621 | 5/1979 | Andrews et al. | 134/10 |

*Primary Examiner*—George Yeung

*Attorney, Agent, or Firm*—Zarley, McKee, Thomte, Voorhees & Sease

[57] ABSTRACT

A machine is provided for rinsing eating utensils and includes a rinse station wherein the utensils are finally rinsed to eliminate spotting thereon. The water used in the final rinse of the utensils is of high quality and contains less than 275 ppm of total dissolved solids. The high quality rinse water is collected in a tank having a heating element therein and pumped to the rinse station after being heated. After each rinse cycle, the water drains back into the tank where it is reheated and recirculated to rinse each additional group of utensils subsequently introduced into the second station until the level of total dissolved solids in the water exceeds 275 ppm.

The method of rinsing eating utensils comprises moving the utensils through a rinse station where they are finally rinsed with a heated quantity of high quality water having less than 275 ppm of total dissolved solids. The high quality rinse water is collected after each rinse cycle, reheated and recirculated for finally rinsing additional utensils subsequently passing through the rinsing station.

2 Claims, 1 Drawing Figure

METHOD OF RINSING EATING UTENSILS

This is a continuation of application Ser. No. 603,164, filed Apr. 23, 1984, now abandoned.

BACKGROUND OF THE INVENTION

Conventional industrial dishwashers usually wash and rinse eating utensils, including dishes, glasses and silverware, in a single compartment. A problem associated with these machines is spotting of the dried utensils caused by dissolved solids in the rinse water. Such spotting is the result of dissolved solids contained in the rinse water. Spotting typically occurs when the level of total dissolved solids in the rinse water exceeds 275 parts per million. Various solutions have been attempted for removing the water spots from the utensils. Addition of chemicals to the rinse water is costly and produces unsatisfactory results. Furthermore, use of such high quality water on a single pass basis for finally rinsing the utensils is cost prohibitive.

Therefore, it is a primary objective of the present invention to provide a method and means for eliminating spotting of washed and rinsed eating utensils.

A further objective of the present invention is the provision of a method and means of re-circulating deionized water in the final rinse of the eating utensils so as to prevent spotting thereon.

Another objective of the present invention is the provision of a separate machine adjacent to the dishwasher which re-circulates the high quality rinse water for repeated use in finally rinsing the eating utensils.

A further objective of the present invention is the provision of a rinse water recirculation system for use in finally rinsing eating utensils which is economical to operate.

SUMMARY OF THE INVENTION

The rinse assembly of the present invention for eliminating spots on eating utensils is used in conjunction with a conventional dishwasher for washing and preliminarily rinsing the utensils. The rinse assembly generally comprises a machine, separate and adjacent to the dishwasher, for finally rinsing the utensils after they have passed through the conventional dishwasher. The eating utensils move through the rinsing machine upon a support tract or conveyor extending therethrough. High quality water is used in the rinse machine to finally rinse the utensils while standard tap water is used in the dishwasher to wash and preliminarily rinse the utensils. The rinsing machine includes a collection tank for holding the high quality rinse water. A heating element in the tank heats the quantity of water therein to at least 180° F. A pump forces the heated water through the water jets in the rinse machine so as to finally rinse the utensils therein. The high quality water used in the final rinse drains back into the tank, wherein a heating element maintains the temperature of the water at 180° F. or above, and is recirculated for rinsing additional utensils subsequently moved through the rinsing machine.

The method for rinsing eating utensils so as to eliminate water spots therefrom commences by moving the utensils from the conventional dishwasher after they are washed and preliminarily rinsed therein to the adjacent rinse machine wherein they are finally rinsed with a high quality quantity of water heated to at least 180° F. and having less than 275 parts per million of total dissolved solids. The utensils are then moved from the final rinse machine for drying. The high quality water used in the final rinse is collected and recirculated to finally rinse additional utensils subsequently moved into the final rinse machine until the level of total dissolved solids in the high quality quantity of water exceeds 275 ppm.

DETAILED DESCRIPTION OF THE DRAWINGS

Figure 1:
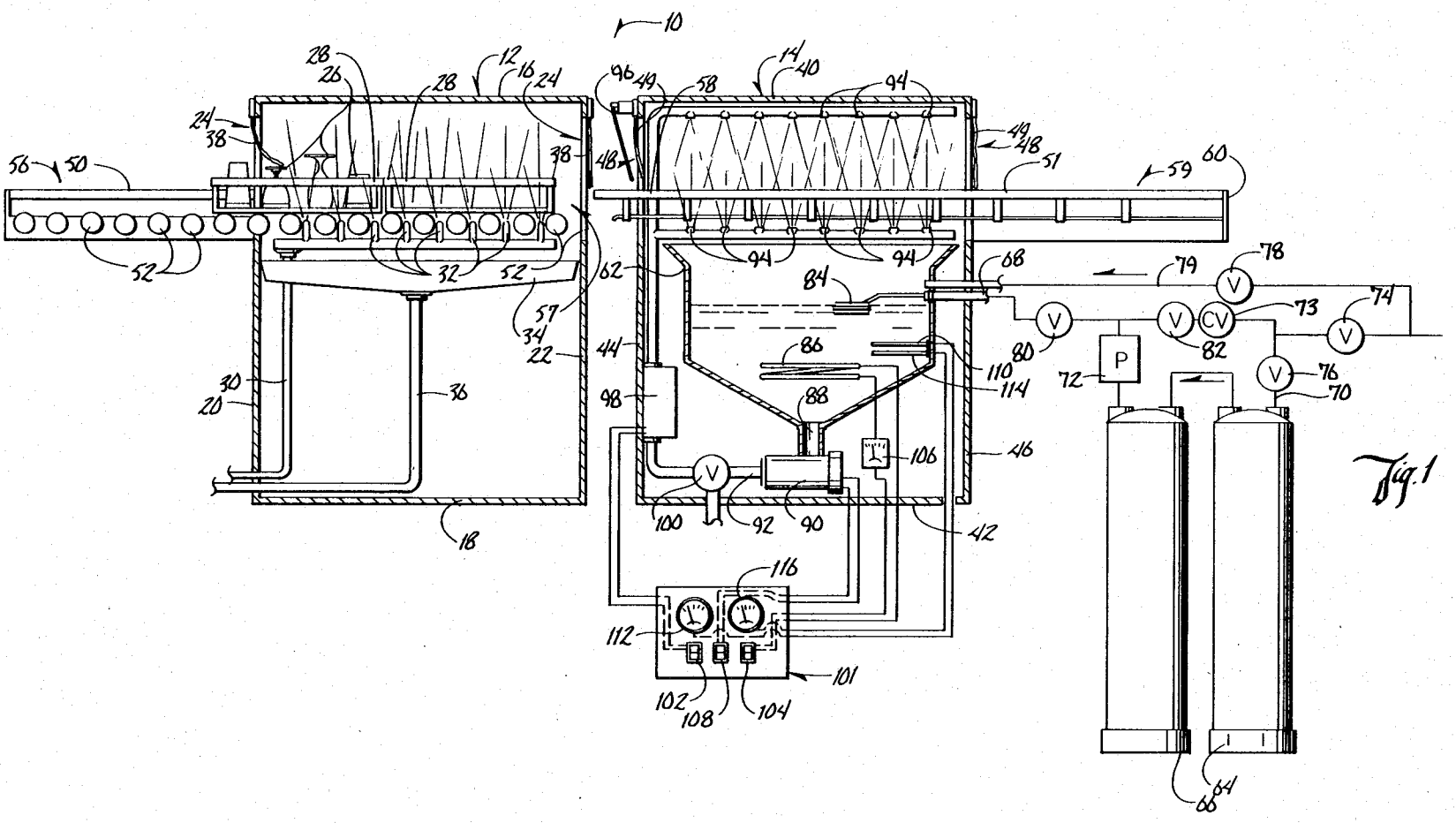
FIG. 1 is a sectional side elevational view of the dishwasher assembly of the present invention.

The numeral 10 generally designates a wash and rinse assembly for dishes and eating utensils. Assembly 10 includes a conventional industrial dishwasher 12 and a separate final rinse machine 14 adjacent dishwasher 12. Dishwasher 12 has a top 16, a bottom 18, and opposite sidewalls 20 and 22. Sidewalls 20 and 22 have openings 24 therein through which utensils 26 may pass. Standard racks 28 may be used for assemblying utensils 26 for convenient movement through assembly 10.

A water supply line 30 provides water from a conventional water source to jets 32 mounted within dishwasher 12 for washing and preliminarily rinsing utensils 26. The wash and rinse water is collected in a tray 34 which may include standard strainers (not shown) and then is discharged out drainpipe 36. Suitable material 38 is provided to cover openings 24 in sidewalls 20 and 22 so as to retain the water and heat within dishwasher 12.

Final rinse machine 14 includes a top 40, a bottom 42 and opposite sides 44 and 46. Sides 44 and 46 have openings 48 therein through which racks 28 filled with eating utensils 26 pass. Suitable material 49 covers openings 48 to retain water and heat within rinse machine 14.

FIG. 1 shows a conventional rack support frame 50 extending through dishwasher 12. A separate support frame 51 extends through final rinse machine 14. Racks 28 are adapted to slide along support frames 50 and 51, both of which may include rollers 52 to facilitate such movement of the rack therealong. Support frame 50 has an upstream end 56 and a downstream 57. Support frame 51 has an upstream end 58 and a downstream end 59. Upstream end 58 of support frame 51 overlaps or is adjacent to downstream end 57 of support frame 50 so that racks 28 may move from support frame 50 to support frame 51 smoothly without interruption. Utensils 26 move first through dishwasher 12 and then through rinse machine 14. A stop element 60 is provided at the downstream end 59 of conveyor assembly 51 to prevent racks 28 filled with utensils 26 from falling therefrom. Alternatively, standard conveyor assemblies may be utilized for moving racks 28 through dishwasher 12 and rinse machine 14.

A collection tank 62 is mounted within rinse machine 14 beneath the portion of support frame 51 extending therethrough. Collection tank 62 receives a quantity of high quality water from a set of conventional water treatment tanks 64 and 66 via water inlet line 68. Tap water from a conventioal water source enters tanks 64 and 66 through inlet line 70 and is treated therein by deionization, reverse osmosis or other similar processes for removing dissolved solids until the level of total dissolved solids in the water is preferably 25 ppm, but at least less than 275 ppm. A pump 72 continues to circulate the water through tanks 64 and 66 so that the quality of the water is maintained. A check valve 73 prevents reverse flow of the water.

The plumbing and valving between the tap water source, treatment tank 64 and 66, and collection tank 62 is such as to permit various selected use of the water. The supply of water from the conventional water source is controlled by first valve 74 and is directed either to treatment tanks 64, 66 via valve 76 or directly to collection tank 62 via valve 78 and inlet line 79 for use in cleaning tank 62. The high quality water produced in tank 64, 66 is pumped therefrom by pump 72 and directed to either tank 62 via valve 80 or recirculated through the treatment tanks by valve 82. Thus, the tap water can be treated and sent to collection tank 62, treated and recirculated for further continuous treatment, or sent directly to collection tank 62 for cleaning purposes. The precise arrangement of the plumbing and valving is not critical but merely illustrative of the versatility of the present invention.

A conventional float 84 is provided in collection tank 62 for controlling the level of high quality deionized water contained therein. Float 84 automatically shuts off valve 80 when a sufficient quantity of water has been pumped into tank 62. Also operatively secured within tank 62 is a heating coil element 86 that heats the water therein to a temperature of at least 180° F. Collection tank 62 has a drain 88 in the bottom thereof which is in communication with a recirculation pump 90 which pumps the heated high quality water through a water line 92 to the water jets 94 positioned above and below support track 50 within rinse machine 14. As the utensils move through opening 48 in sidewall 44 of rinse machine 14, rack 28 or the utensils therein engage a switch 96 which actuates pump 90 such that heated water is provided to jets 94 for finally rinsing the utensils as they pass through machine 14. An additional heating means 98 is provided in water line 92 to maintain the temperature of the water passing therethrough. A valve 100 is also provided in water line 92 such that the water can be drained from collection tank 62 when the level of total dissolved solids therein exceeds 275 ppm or such that the water used for cleaning the tank can be drained therefrom.

A control panel 101 permits regulation of the final rinse process. A first switch 102 controls the activation of heating means 98 while a second switch 104 controls the activation of heating coils 86 in conjunction with the thermostat 106. A third switch 108 supplies electricity to pump 90 which is then actuated by the tripping of switch 96. A temperature probe 110 extends into tank 62 so as to sense the temperature of the water therein, such temperature being registered on thermometer 112. Similarly, a conventional dissolved solids sensor 114 extends into tank 62 so as to sense the level of total dissolved solids of the water contained therein, such level being registered on a gauge or meter 116.

In operation, tank 62 is filled with high quality water from treatment tanks 64, 66 and heating coil 86 is actuated to heat the quantity of water to at least 180° F. The high quality water initially contains less than 275 ppm of total dissolved solids and preferably has only 25 ppm of total dissolved solids.

Utensils 26 are loaded into rack 28 and then moved along support track 50 into conventional dishwasher 12 wherein the utensils are washed and preliminarily rinsed. Conventional control or switching means (not shown) activates the wash and preliminary rinse cycle upon the movement of rack 28 into dishwasher 12. After the wash and preliminary rinse cycle is completed, the rack of utensils is moved through opening 24 in sidewall 22 of dishwasher 12 and then through opening 48 in sidewall 44 of final rinse machine 14. Such movement of the rack of utensils into final rinse machine 14 activates switch 96 such that the heated high quality deionized water contained within collection tank 62 is pumped by pump 90 to water jets 94 so as to finally rinse the utensils. The utensils are then moved to the downstream end 58 of support track 50 where they are permitted to dry. The water used in finally rinsing the utensils is received by tank 62 wherein it is reheated for further recirculating use in finally rinsing additional utensils.

During each final rinse cycle, the high quality rinse water accumulates additional dissolved solids. When the level of total dissolved solids within the rinse water exceeds 275 ppm, as sensed by probe 114, valve 100 is opened such that the water can be drained from tank 62. Tank 62 can then be cleaned or refilled with a new supply of high quality water from treatment tanks 64 and 66. Also, if necessary, valve 80 can be partially opened by manual means or by continuously draining off a portion of the high quality water from collection tank 62 such that a continuous flow of high quality water from tanks 64 and 66 is supplied to collection tank 62.

It is understood that conventional dishwasher 12 and rack support frame 50 are not a part of the present invention. Furthermore, it is understood that the precise structure and arrangement of the components of final rinse machine 14 and the water treatment system may take various forms without departing from the scope of the present invention.

The recirculating use of heated high quality water for finally rinsing eating utensils economically and efficiently eliminates spotting thereon. Thus, at least all of the stated objectives are accomplished by the present invention.

What is claimed is:

1. A method of finally rinsing eating utensils after said utensils have been washed so as to avoid water spots thereon, comprising:

moving said utensils to a final rinse station from a separate wash station, finally rinsing said utensils in said final rinse station with a quantity of water heated to at least 180° F. and having less than 275 ppm of total dissolved solids, said quantity of water accumulating additional dissolved solids during said final rinsing, moving said utensils from said final rinse station, collecting said quantity of water after said utensils are finally rinsed, maintainig the temperature of said quantity of water at a minimum of 180° F., and rinsing additional utensils subsequently moved into said final rinse station with said collected quantity of water without further treatment thereof to reduce the level of total dissolved solids in said quantity of water until the level of total dissolved solids in said quantity of water exceeds 275 ppm.

2. A method of rinsing a plurality of groups of eating utensils after said utensils have been washed to avoid water spotting thereon, comprising:

(a) sequentially moving each group of eating utensils through a final rinse station, (b) finally rinsing each group of utensils in said final rinse staton as said group moves therethrough with a first quantiy of water heated to at least 180° F. and containing less than 275 ppm of total dissolved solids, said first quantity of water being collected and reheated after each group of utensils is finally rinsed and, without additional treatment to remove additional dissolved solids acquired during said final rinsing, recirculated for finally rinsing each subsequent group of utensils;

(c) discharging said first quantity of water when the level of total dissolved solids exceeds 275 ppm; and (d) replacing said discharged first quantity of water with a second quantity of water and having less than 275 ppm of total dissolved solids for rinsing additional groups of utensils in accordance with steps (a)-(c) above.

* * * * *